US005222899A

United States Patent [19]

Hulderman

[11] Patent Number: 5,222,899

[45] Date of Patent: Jun. 29, 1993

[54] ELECTROSTATIC DISCHARGE SAFETY CONNECTOR FOR ELECTRO-EXPLOSIVE DEVICES

[75] Inventor: George H. Hulderman, Tucson, Ariz.

[73] Assignee: Hughes Aircraft Company, Los Angeles, Calif.

[21] Appl. No.: 880,413

[22] Filed: May 8, 1992

[51] Int. Cl.[5] ..... H01R 29/00

[52] U.S. Cl. ..... 439/188; 439/141; 439/187; 439/513

[58] Field of Search ..... 439/186-188, 439/140, 141, 147, 367, 509, 513, 521, 522, 892, 893, 934; 200/51.09, 51.1

[56] References Cited

U.S. PATENT DOCUMENTS

| | | | |
|---|---|---|---|
| 3,491,326 | 1/1970 | Pfister et al. | 439/141 |
| 3,508,188 | 4/1970 | Buck | 439/141 |
| 4,659,160 | 4/1987 | Jonval | 439/187 |
| 5,052,484 | 10/1991 | Gesta | 439/188 |
| 5,145,391 | 9/1992 | Alwine | 439/188 |

*Primary Examiner*—Paula A. Bradley
*Attorney, Agent, or Firm*—C. D. Brown; R. M. Heald; W. K. Denson-Low

[57] ABSTRACT

An electrostatic discharge-safe connector comprising mating male and female connectors, that includes an insulated connector pin and a shorting member comprising an electromagnetic interference (EMI) sandwich structure that shorts the connector pin to the body of the connector when the mating portions are unmated. The EMI sandwich structure comprises an EMI gasket material sandwiched between two layers of insulating material. The EMI gasket material has a bulk resistivity of less than 10 ohms per square. When the male connector is inserted into the female connector, the EMI sandwich structure moves away from the conducting portion of the connector pin and rides against the insulating sleeve that surrounds the connector pin. This prevents conduction of electrical charge to the pin from the shell or vice versa. The present connector thus provides protection against electrostatic discharge. When used in safety and arming devices and initiation safety devices, such as are employed in missiles, for example, it also prevents in-line devices from remaining in an armed condition after test, and provides a safety for an armed device upon separation of the male and female connector.

10 Claims, 2 Drawing Sheets

ELECTROSTATIC DISCHARGE SAFETY CONNECTOR FOR ELECTRO-EXPLOSIVE DEVICES

BACKGROUND

The present invention relates generally to electrical connectors, and more particularly, to an electrostatic discharge-safe electrical connector for use with electro-explosive devices.

In conformance with current practices, most electro-explosive devices require a shorting bar or shorting cap and/or an EMI (RF) shield on the connectors thereof when they are not in use. These conventional devices often fall off during handling, while some of them are expensive and are recycled. In addition, if there is a failure in a safety and arming device used in an electro-explosive device such as a missile, for example, high voltage can find an electrical path to squibs of the device and cause a device failure. Such failures are costly, in that expensive redesign may be required, and at a minimum, additional testing will be required.

In view of the above, there is a need for electrostatic discharge-safe electrical connectors on sensitive electro-explosive devices used in military and commercial applications in order to eliminate the need for shorting devices, and the like. There is also a need for an electrostatic discharge-safe electrical connector that is employed on an electrostatic discharge sensitive device, particularly where the device is subject to repeated test and rework in an uncontrolled environment, such as in auto service centers, for example.

SUMMARY OF THE INVENTION

In order to satisfy the above enumerated needs, the present invention comprises an electrostatic discharge safe connector comprising male and mating female connectors. The male connector includes a shell comprising a connector pin support structure. A connector pin having an insulating sleeve around a portion of its length is secured in the connector pin support structure adjacent a closed end thereof. A resilient member, such as a spring, is disposed around the periphery of the connector pin adjacent the closed end of the male connector. A shorting member is disposed adjacent the spring. The shorting member is comprised of an electromagnetic interference (EMI) sandwich structure that includes an EMI gasket material sandwiched between two layers of insulating material. The EMI gasket material has a bulk resistivity of less than 10 ohms per square.

A retaining member, such as a retaining ring secured in a groove formed in the shell, is adapted to secure the EMI sandwich structure (shorting member) in the male connector. The female connector includes a shell comprising a socket support structure and a connector socket disposed in the socket support structure that is adapted to mate with the connector pin when the two connectors are mated.

The heart of the invention is the insulated connector pin and the EMI sandwich structure (shorting member). The electrostatic discharge safe connector is designed such that when unmated, the connector pin is shorted to the male connector shell. When the male connector is inserted into the female connector, the shorting member, comprising the EMI sandwich structure, moves away from the conducting portion of the connector pin and rides against the insulating sleeve that surrounds one end of the connector pin. This prevents conduction of electrical charge to the pin from the shell, or vice versa.

The present connector provides protection against electrostatic discharge (ESD). When used in safety and arming devices and initiation safety devices, such as are employed in missiles, for example, it also prevents "in-line" devices from remaining in an armed condition after test, and will dud an armed device upon removal of the mating half of the connector.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
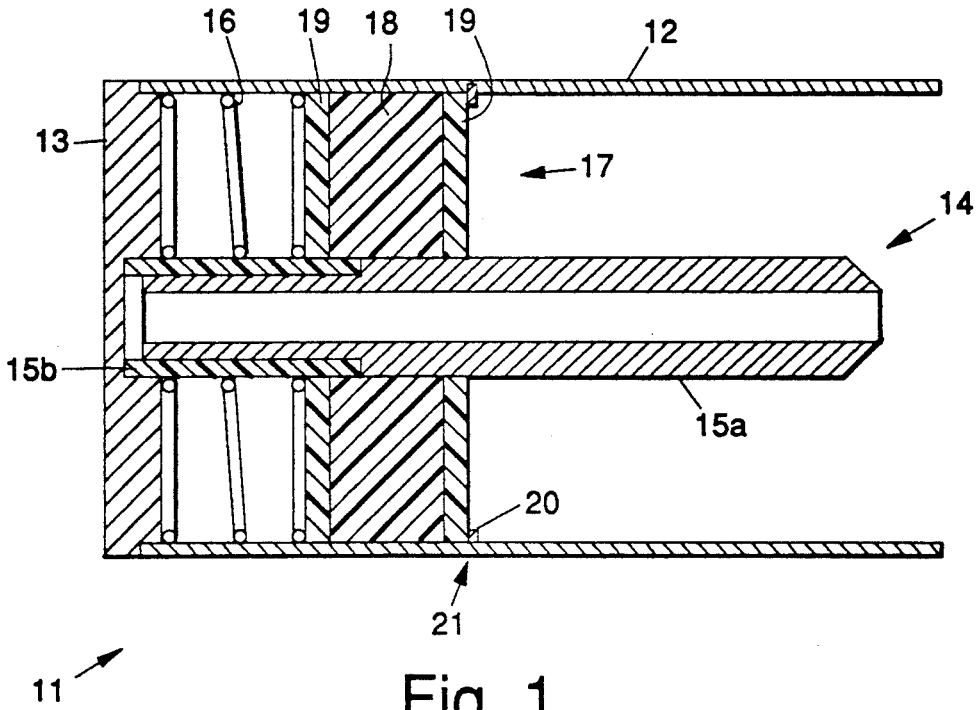
FIG. 1 shows a cross sectional view of a male portion of a connector in accordance with the principles of the present invention.

Referring to the drawings figures, FIG. 1 shows a cross sectional view of a male portion 11 of a connector 10 in accordance with the principles of the present invention. The male portion 11 of the connector 10 is comprised of a body or shell 12 having a connector pin support structure 13 coupled thereto. The shell 12 is closed at the end adjacent the connector pin support structure 13 and is open at its end distal from the connector pin support structure 13. A connector pin 14, having an insulating sleeve **15*b* surrounds a part of a conductive portion 15*a*, is secured in the connector pin support structure 13. The connector pin 14 extends along an axis of the male portion 11 of the connector 10 but does not extend the end of the shell 12. The shell 12 and the connector pin support structure 13 are conventional, and may be comprised of metal or plastic, for example, depending upon the connector application. In general, except for the novel portions of the present invention, the components of the connector 10** are fabricated in a conventional manner from conventional materials routinely used in the connector industry.

A resilient member, or spring 16 is disposed around the periphery of the connector pin 14 and is captivated by the shell 12. A shorting member comprising an electromagnetic interference (EMI) sandwich structure 17 is disposed on top of the spring 16 such that one of the insulating layers 19 is viewable from the open end of the male portion 11 of the connector 10. The EMI sandwich structure 17 is comprised of an EMI gasket material 18 sandwiched between two layers of insulating material 19. Retaining means, such as a retaining ring 20 secured in a groove 21 formed in the shell 12, for example, is adapted to secure the EMI sandwich structure 17 in the male portion 11 of the connector 10. In accordance with the present invention, the EMI gasket material 18 has a bulk resistivity of less than 10 ohms per square.

Figure 2:
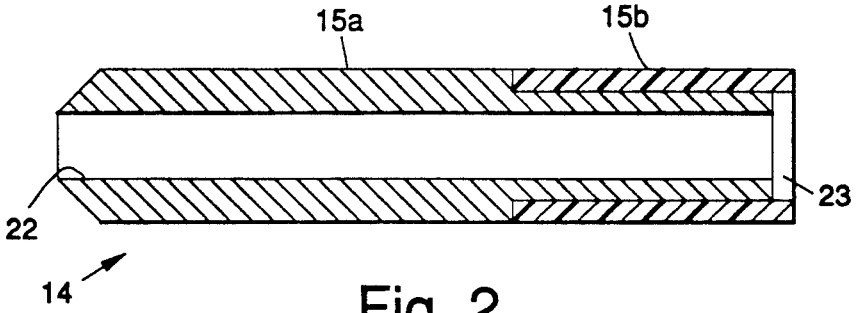
FIG. 2 shows a cross sectional view of an insulated conductor employed in the connector of FIG. 1.

FIG. 2 shows an enlarged cross sectional view of the insulated conductor pin 14 employed in the male portion 11 of the connector 10 of FIG. 1. As can be seen in FIG. 2, the connector pin 14 is generally round and is cylindrical in structure having a central longitudinal opening 22 therethrough. The connector pin 14 also has a second opening 23 at an end adjacent the location of the insulating sleeve 15*b*.

Figure 3:
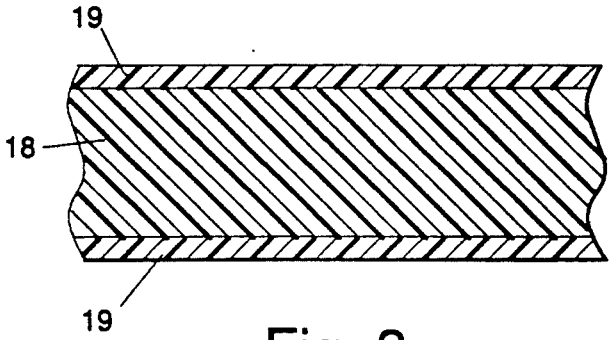
FIG. 3 illustrates a cross sectional view of an "EMI sandwich" employed in the connector of FIG. 1 that comprises an EMI gasket material and an insulating material.

FIG. 3 illustrates a cross sectional view of a portion of the EMI sandwich structure 17 employed in the male portion 11 of the connector 10 of FIG. 1. As was stated above, the EMI sandwich structure 17 comprises the EMI gasket material 18 and two layers of insulating material 19 disposed surrounding it. The electromagnetic interference (EMI) sandwich structure 17 shown in FIG. 3, is comprised of an EMI gasket material 18 having a bulk resistivity of less than 10 ohms, sandwiched between two pieces of insulating material 19. The precise gasket and insulating materials selected is dictated by the requirements of the specific application, subject to the EMI gasket material 18 having the proper bulk resistivity value.

Figure 4:
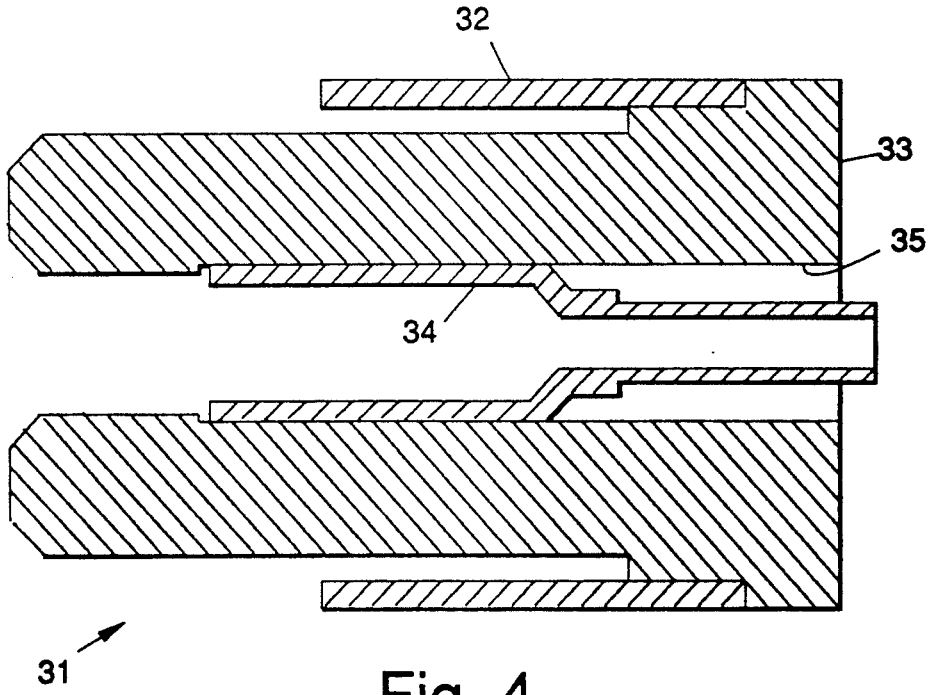
FIG. 4 shows a cross sectional view of a female portion of a connector in accordance with the principles of the present invention.

FIG. 4 shows a cross sectional view of a female portion 31 of a connector 10 in accordance with the principles of the present invention. The female portion 31 of a connector 10 is comprised of a body or shell 32 (socket half) having a socket support structure 33 coupled thereto. A connector socket 34 is disposed within an interior opening 35 of the socket support structure 33. The connector socket 34 is sized to mate with the connector pin 14 when the male and female portions 11, 31 of the connector 10 are mated.

Figure 5:
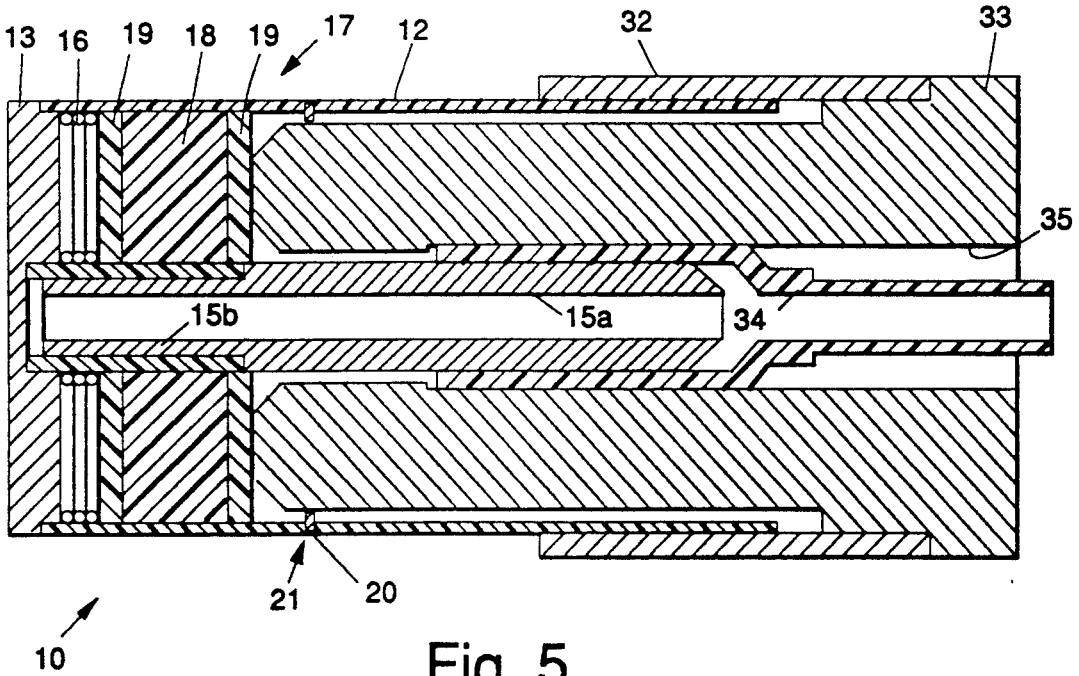
FIG. 5 shows a cross sectional view of the male and female connector portions of FIGS. 1 and 4 mated together.

FIG. 5 shows a cross sectional view of the male and female connector portions 11, 31 of FIGS. 1 and 4 mated together to form a complete connector 10. When mated, the end of the socket support structure 33 of the female connector portion 31 presses against the EMI sandwich structure 17 and compresses the spring 16, while the connector socket 34 mates with and contacts the connector pin 14 to provide for electrical connection of the two portions 11, 31 of the connector 10.

The heart of the connector 10 of the present invention is vested in the insulated connector pin 14 shown in FIG. 2 and the EMI sandwich structure 17 shown in FIG. 3. The connector 10 is designed such that when unmated, all of the connector pins 14 are shorted to the connector shell 12. When the male portion 11 of the connector 10 is inserted into the female portion 31 to make a connection, the shorting member, comprising the EMI sandwich structure 17 moves away from the conducting portion of the connector pin 14 and rides against the insulating sleeve 15*b* that surrounds one end of the connector pin 14.

The present connector 10 provides protection against electrostatic discharge (ESD). When used in safety and arming devices and initiation safety devices, such as are employed in missiles, for example, it also prevents "in-line" devices from remaining in an armed condition after test, and will dud an armed device upon removal of the male portion 11 of the connector 31 (or vice versa, depending on the configuration of the connector. The connector 10 of the present invention is simple to construct, and the basic principles of the invention may be incorporated into the design of substantially any connector.

When the male and female portions 11, 31 of the connector 10 are not connected, the spring 16 keeps the conducting portion of the EMI gasket material 18 positioned such that it is in contact with the conducting portion of the connector pin 14, and the shell 12. In addition, the spring 16 keeps the gasket material 18 in compression between the two EMI sandwich insulating layers 19, and the retainer ring 22. Keeping the gasket material 18 in compression assures good electrical contact between the pin 14 and shell 12.

When interconnection is made between the male and female portions 11, 31 of the connector 10, the socket support structure 33 contacts the insulating layer 19 of the EMI sandwich structure 17, forcing the EMI gasket material 18 away from the conducting portion of the connector pin 14, breaking the electrical conduction path between the pin 14 and the shell 12. When interconnection is completed, the socket, 34 engages the connector pin 14, completing the intended function of the connector 10. When the male and female portions 11, 31 of the connector 10 are disconnected, the spring 16 forces the EMI gasket material 18 to contact the connector pin 14, again providing electrostatic discharge protection. Additionally, by shorting all pins 14 together and to the connector shell 12 discharges any electrical stored energy that may remain as a result of a functional test of such devices as safety and arming devices or initiation safety devices.

Thus there has been described a new and improved electrostatic discharge safe connector for electro-explosive devices. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. An electrostatic discharge safe connector comprising:

a male connector shell comprising a connector pin support structure disposed at a closed end;

a connector pin comprising an insulating sleeve disposed along a portion of its length, and wherein the connector pin is disposed in the connector pin support structure adjacent the insulating sleeve;

a resilient member disposed around the periphery of the connector pin adjacent the closed end of the male connector shell;

a shorting member disposed adjacent the resilient member;

retaining means disposed in the male connector shell for securing the shorting member therein;

a female connector shell comprising a socket support structure disposed at a closed end;

a connector socket disposed in the socket support structure that is adapted to mate with the connector pin of the male connector shell when the male and female shells are mated.

2. The connector of claim 1 wherein shorting member is comprised of an electromagnetic interference (EMI) sandwich structure comprising an EMI gasket material sandwiched between two layers of insulating material.

3. The connector of claim 1 wherein the EMI gasket material has a bulk resistivity of less than 10 ohms per square.

4. The connector of claim 1 wherein retaining means is comprised of a retaining ring disposed in a groove formed in the male connector shell.

5. An electrostatic discharge safe connector comprising:

a male connector shell having a connector pin support structure disposed at a closed end thereof;

a connector pin having an insulating sleeve disposed at one end thereof along a portion of its length, and wherein the connector pin is disposed in the connector pin support structure adjacent the insulating sleeve;

a spring disposed around the periphery of the connector pin adjacent the closed end of the male connector shell;

an electromagnetic interference (EMI) sandwich structure comprising an EMI gasket material having a bulk resistivity of less than 10 ohms per square sandwiched between two layers of insulating material disposed adjacent the spring at a position distal from the closed end of the male connector shell;

a retaining ring secured in a groove formed in the shell that is adapted to secure the EMI sandwich structure in the male connector shell;

a female connector shell having a socket support structure disposed at a closed end thereof;

a connector socket disposed in the socket support structure that is adapted to mate with the connector pin of the male connector shell when the male and female shells are mated.

6. In a connector comprising a male connector shell having an open end and having a connector pin support structure disposed disposed at a closed end thereof, and having a connector pin comprising an insulating sleeve disposed in the connector pin support structure, and a female connector shell having a connector socket disposed at a closed end thereof that is adapted to mate with the connector pin of the male connector shell when the male and female shells are mated, and wherein the improvement comprises:

a shorting member disposed adjacent the closed end of the male shell;

a resilient member disposed between the shorting member and the closed end of the male shell and around the periphery of the connector pin; and retaining means disposed in the male shell for retaining the shorting member therein;

wherein when the male and female shells are unmated, the connector pin is shorted to the connector shell by the shorting member, and when the male shell is inserted into the female connector shell, the shorting member moves away from the conducting portion of the connector pin and rides against the insulating sleeve.

7. The connector of claim 6 wherein shorting member is comprised of an electromagnetic interference (EMI) sandwich structure comprising an EMI gasket material sandwiched between two layers of insulating material.

8. The connector of claim 6 wherein the EMI gasket material has a bulk resistivity of less than 10 ohms per square.

9. The connector of claim 6 wherein the resilient member comprises a spring.

10. The connector of claim 6 wherein retaining means is comprised of a retaining ring disposed in a groove formed in the male connector shell.

* * * * *